US007637722B1

(12) United States Patent
Koepsel et al.

(10) Patent No.: US 7,637,722 B1
(45) Date of Patent: Dec. 29, 2009

(54) MARINE PROPELLER

(75) Inventors: Roger E. Koepsel, Oshkosh, WI (US); David M. DeWitt, Fond du Lac, WI (US); Jeremy L. Alby, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 577 days.

(21) Appl. No.: 11/526,954

(22) Filed: Sep. 26, 2006

(51) Int. Cl.
*B63H 1/26* (2006.01)

(52) U.S. Cl. ..... 416/238; 416/241 R; 416/244 B

(58) Field of Classification Search ..... 416/245 A, 416/244 B, 247 A, 238, 241 R
See application file for complete search history.

(56) References Cited

U.S. PATENT DOCUMENTS

| | | | | | |
|---|---|---|---|---|---|
| 3,788,267 | A | | 1/1974 | Strong | 115/17 |
| 4,780,058 | A | * | 10/1988 | Phillips | 416/242 |
| 4,789,306 | A | * | 12/1988 | Vorus et al. | 416/223 R |
| 4,802,822 | A | | 2/1989 | Gilgenbach et al. | 416/235 |
| 4,865,520 | A | | 9/1989 | Hetzel et al. | 416/236 R |
| D319,210 | S | | 8/1991 | Koepsel et al. | D12/214 |
| 5,104,292 | A | | 4/1992 | Koepsel et al. | 416/223 R |
| 5,114,313 | A | | 5/1992 | Vorus | 416/93 A |
| 5,158,433 | A | | 10/1992 | Cleary | 416/93 A |
| 5,236,310 | A | | 8/1993 | Koepsel et al. | 416/223 R |
| 5,352,093 | A | * | 10/1994 | Hannon et al. | 416/234 |
| 5,368,508 | A | | 11/1994 | Whittington | 440/49 |
| 5,405,243 | A | * | 4/1995 | Hurley et al. | 416/189 |
| 5,464,321 | A | | 11/1995 | Williams et al. | 416/93 A |
| D368,886 | S | | 4/1996 | Kuryliw | D12/214 |
| 5,527,195 | A | | 6/1996 | Neisen | 440/89 |
| 5,791,874 | A | | 8/1998 | Lang | 416/62 |
| D442,906 | S | | 5/2001 | Prokop | D12/214 |
| 6,390,776 | B1 | | 5/2002 | Gruenwald | 416/203 |
| 6,699,016 | B1 | | 3/2004 | Dean | 416/235 |
| 7,025,642 | B1 | | 4/2006 | Baylor | 440/49 |
| 2005/0175458 | A1 | * | 8/2005 | Romero Vazquez | 416/204 R |
| 2005/0233654 | A1 | * | 10/2005 | Mueller | 440/49 |

OTHER PUBLICATIONS

Ukon, Yoshitaka, Research on Design and Application of Super-Cavitating Propellers, 1996, SRI, vol. 33, No. 3. p. 151-180. (in Japanese accessed through google search, citation available through National Maritime Research Institute).*

* cited by examiner

*Primary Examiner*—Edward Look
*Assistant Examiner*—Jesse Prager
(74) *Attorney, Agent, or Firm*—William D. Lanyi

(57) ABSTRACT

A marine propeller is provided with three blades, a skew angle of approximately 33 degrees, a rake angle of approximately 28.5 degrees, and a blade area ratio (BAR) of approximately 60 degrees. The rake is preferably progressive. Each of the blades is preferably tail loaded.

10 Claims, 14 Drawing Sheets

| ROW # | BLADE # | RAKE ANGLE | BAR | PITCH LOAD TAIL/UNIFORM | SKEW | TOP SPEED (mph) |
|---|---|---|---|---|---|---|
| 1 | 3 | 15 | 50 | -1 | 33 | 37.5 |
| 2 | 3 | 15 | 50 | 1 | 10 | 35.6 |
| 3 | 3 | 15 | 60 | -1 | 10 | 38.2 |
| 4 | 3 | 15 | 60 | 1 | 33 | 38 |
| 5 | 3 | 25 | 50 | -1 | 10 | 37 |
| 6 | 3 | 25 | 50 | 1 | 33 | 37.6 |
| 7 | 3 | 25 | 60 | -1 | 33 | 38.3 |
| 8 | 3 | 25 | 60 | 1 | 10 | 37.1 |
| 9 | 4 | 15 | 50 | -1 | 10 | |
| 10 | 4 | 15 | 50 | 1 | 33 | |
| 11 | 4 | 15 | 60 | -1 | 33 | 36.9 |
| 12 | 4 | 15 | 60 | 1 | 10 | |
| 13 | 4 | 25 | 50 | -1 | 33 | 36 |
| 14 | 4 | 25 | 50 | 1 | 10 | |
| 15 | 4 | 25 | 60 | -1 | 10 | 36.4 |
| 16 | 4 | 25 | 60 | 1 | 33 | 37.3 |

*FIG. 6*

| ROW # | BLADE # | RAKE ANGLE | BAR | PITCH LOAD TAIL/UNIFORM orm | SKEW | ACCEL 0-20 (sec) |
|---|---|---|---|---|---|---|
| 1 | 3 | 15 | 50 | -1 | 33 | 6.5 |
| 2 | 3 | 15 | 50 | 1 | 10 | 7.4 |
| 3 | 3 | 15 | 60 | -1 | 10 | 6.4 |
| 4 | 3 | 15 | 60 | 1 | 33 | 6.6 |
| 5 | 3 | 25 | 50 | -1 | 10 | 6.6 |
| 6 | 3 | 25 | 50 | 1 | 33 | 6.6 |
| 7 | 3 | 25 | 60 | -1 | 33 | 6.2 |
| 8 | 3 | 25 | 60 | 1 | 10 | 6.4 |
| 9 | 4 | 15 | 50 | -1 | 10 | 10 |
| 10 | 4 | 15 | 50 | 1 | 33 | 10 |
| 11 | 4 | 15 | 60 | -1 | 33 | 10 |
| 12 | 4 | 15 | 60 | 1 | 10 | 10 |
| 13 | 4 | 25 | 50 | -1 | 33 | 10 |
| 14 | 4 | 25 | 50 | 1 | 10 | 10 |
| 15 | 4 | 25 | 60 | -1 | 10 | 10 |
| 16 | 4 | 25 | 60 | 1 | 33 | 6.3 |

*FIG. 7*

| ROW # | BLADE # | RAKE ANGLE | BAR | PITCH LOAD TAIL/UNIFORM | SKEW | ACCELERATION 0-30 mph (sec) |
|---|---|---|---|---|---|---|
| 1 | 3 | 15 | 50 | -1 | 33 | 15.2 |
| 2 | 3 | 15 | 50 | 1 | 10 | 20.3 |
| 3 | 3 | 15 | 60 | -1 | 10 | 17 |
| 4 | 3 | 15 | 60 | 1 | 33 | 17.1 |
| 5 | 3 | 25 | 50 | -1 | 10 | 17 |
| 6 | 3 | 25 | 50 | 1 | 33 | 16.1 |
| 7 | 3 | 25 | 60 | -1 | 33 | 15.2 |

*FIG. 8*

| ROW # | BLADE # | RAKE ANGLE | BAR | PITCH LOAD TAIL/UNIFORM | SKEW | CRUISE SPEED (mph) |
|---|---|---|---|---|---|---|
| 1 | 3 | 15 | 50 | -1 | 33 | 17.6 |
| 2 | 3 | 15 | 50 | 1 | 10 | 16.2 |
| 3 | 3 | 15 | 60 | -1 | 10 | 16.7 |
| 4 | 3 | 15 | 60 | 1 | 33 | 16.6 |
| 5 | 3 | 25 | 50 | -1 | 10 | 17.6 |
| 6 | 3 | 25 | 50 | 1 | 33 | 16.8 |
| 7 | 3 | 25 | 60 | -1 | 33 | 21.1 |
| 8 | 3 | 25 | 60 | 1 | 10 | 17.6 |
| 9 | 4 | 15 | 50 | -1 | 10 | 10 |
| 10 | 4 | 15 | 50 | 1 | 33 | 10 |
| 11 | 4 | 15 | 60 | -1 | 33 | 10 |
| 12 | 4 | 15 | 60 | 1 | 10 | 10 |
| 13 | 4 | 25 | 50 | -1 | 33 | 10 |
| 14 | 4 | 25 | 50 | 1 | 10 | 10 |
| 15 | 4 | 25 | 60 | -1 | 10 | 10 |
| 16 | 4 | 25 | 60 | 1 | 33 | 15.1 |

*FIG. 9*

MARINE PROPELLER

BACKGROUND OF THE INVENTION

1. Field of the Invention

The present invention is generally related to a marine propeller and, more specifically, to a marine propeller that is particularly configured to improve the maximum velocity, acceleration, and cruise speed characteristics of a marine vessel used in conjunction with the marine propeller.

2. Description of the Related Art

Those skilled in the art of marine propellers design are familiar with many different combinations of characteristics of marine propellers that affect its performance under various conditions.

U.S. Pat. No. 3,788,267, which issued to Strong on Jan. 29, 1974, discloses an anti-cavitation means for marine propulsion devices. Cavitation emanating from the leading edge near the hub of a propeller of a marine propulsion device is prevented by introducing exhaust gas air adjacent the junction of the leading edge of each blade of the propeller and the propeller hub from the interior of the hub through which the exhaust gas or air flows.

U.S. Pat. No. 4,789,306, which issued to Vorus et al. on Dec. 6, 1988, describes a marine propeller. A multi-bladed marine propeller is designed for efficient operation in intermediate, partially cavitating flow regions between fully cavitating flow and non-cavitating flow. Each of the blades has a radially inner sub-cavitating section and an outer section which is configured to have a higher angle of attack and tapered trailing and leading edges so that it super cavitates at high speeds either with or without ventilation and subcavitates at lower speeds. Various other features of each blade include different length cords on the pressure and suction sides of the outer section and an inclined trailing surface area extending between the cord ends for improved off-design, design point, and stern operation.

U.S. Pat. No. 4,802,822, which issued to Gilgenbach et al. on Feb. 7, 1989, discloses a marine propeller with optimized performance blade contour. The propeller combines decreasing overall pitch from hub to blade tip and increasing progressiveness of pitch with increasing radii from hub to tip, and provides uniform loading from hub to tip. The blade has a maximum transverse dimension between the high pressure surface of the blade and a straight line chord between the leading edge and the trailing edge of the blade. The ratio of this maximum transverse dimension to the length of the chord is ever increasing from hub to tip. A parabolic blade rake along the maximum radial dimension line of the blade is provided in combination.

U.S. Pat. No. 4,865,520, which issued to Hetzel et al. on Sep. 12, 1989, discloses a marine propeller with an addendum. The propeller has a plurality of blades each with an integral addendum extending rearwardly from the trailing edge of the positive pressure surface of the blade. A particular combination of blade area ratio and blade rake is provided to enable quick acceleration to a high speed on plane condition in blade surfacing racing applications, and without bobbing up and down. The blade area ratio is at least 40 percent and the blade rake is 10 to 25 degrees.

U.S. Design Pat. D319,210, which issued to Koepsel et al. on Aug. 20, 1991, discloses a five blade marine propeller.

U.S. Pat. No. 5,104,292, which issued to Koepsel et al. on Apr. 14, 1992, discloses a marine propeller with performance pitch, including a five blade version. The propeller combines progressive pitch with both increasing pitch and increasing progressiveness of pitch along at least a portion of increasing radii from the axis of rotation to the outer blade tip. A five blade propeller is provided which accommodates thermal warpage of the outer blade tips, such that the same propeller includes two different types of blades, one blade having increasing pitch with increasing radii all the way to the outer blade tip and the other type of blade having increasing pitch to a given radius and then decreasing pitch with increasing radii to the outer blade tip.

U.S. Pat. No. 5,114,313, which issued to Vorus on May 19, 1992, describes a base vented subcavitating marine propeller. The propeller consists of a central having a hollow body of circular cross-sectional shape through which exhaust gas from the motor can flow. Integrally formed with the hub are a number of arcuate blades. Each blade has a generally fish-shaped axial cross-sectional shape. In particular, from the leading edge of the blade, the cross-sectional shape increases in thickness until reaching a local maximum at a point near the midchord of the blade and thereafter decreases in thickness until reaching a local minimum.

U.S. Pat. No. 5,158,433, which issued to Cleary on Oct. 27, 1992, discloses a marine propeller having an outwardly flared hub. The propeller includes an inner hub to receive a driving connection to the engine and an outer hub which is spaced outwardly from the inner hub to provide a passage therebetween for the discharge of exhaust gas from the engine. After casting the trailing end of the outer hub is swaged outwardly by a tapered tool to provide an outwardly flared trailing end which assists gas flow and enhances performance of the engine.

U.S. Pat. No. 5,236,310, which issued to Koepsel et al. on Aug. 17, 1993, discloses a marine propeller with performance pitch, including a five blade version. The propeller combines progressive pitch with both increasing pitch and increasing progressiveness of pitch along at least a portion of increasing radii from the axis of rotation to the outer blade tip.

U.S. Pat. No. 5,368,508, which issued to Whittington on Nov. 29, 1994, describes a marine propeller with transversal converging ribs. The propeller includes arcuate ribs extending from each blade surface. Each rib is widely spaced at the blade's leading edge and curves inwardly towards the propeller hub to substantially converge at the blade's trailing edge.

U.S. Pat. No. 5,464,321, which issued to Williams et al. on Nov. 7, 1995, describes a marine propeller. The propeller uses the circulation control principal of blowing tangentially over a Coanda surface at the trailing edge of each blade to develop high blade lift. Each blade has internal chambers and two blowing slots so that blowing is controllable for forward and reverse thrust without reversing rotational direction of the propeller.

U.S. Design Pat. D368,886, which issued to Kuryliw on Apr. 16, 1996, describes a boat propeller.

U.S. Pat. No. 5,527,195, which issued to Neisen on Jun. 18, 1996, is discloses a flow through marine propeller. The propeller has an integral aft skirt portion, with a plurality of slots extending forwardly from the trailing end and dividing the skirt portion into a plurality of circumferentially spaced segments separated from each other at the trailing end by respective slots therebetween and integrally joined to each other at the outer hub forward of the slots.

U.S. Pat. No. 5,791,874, which issued to Lang on Aug. 11, 1998, discloses a marine propeller with adjustable cupping. The propeller includes a hub rotatable about a longitudinal axis and having a plurality of blades extending outwardly from the hub. Each of the propeller blades includes a fixed propeller blade stem and a removable cup extension.

U.S. Design Pat. D442,906, which issued to Prokop on May 29, 2001, describes a marine propeller with thrust edges.

U.S. Pat. No. 6,390,776, which issued to Gruenwald on May 21, 2002, discloses a marine propeller. It has increased performance in reverse gear and has a hub and a multiplicity of blades extending radially outward. A portion of the trailing edges of some or all of the blades are modified to lessen interference between blades and increase the bite of those blades when operated in reverse.

U.S. Pat. No. 6,699,016, which issued to Dean on Mar. 2, 2004, describes a boat propeller. The propeller is provided with a hub having a plurality of outwardly extending blades and at least one reverse thrust member connected to a selected blade of the propeller. The blade to which the reverse thrust member is connected can provide a blade pitch that is constant, variable, progressive, or regressive. The reverse thrust member is formed integrally with or connected to a leading edge of the selected blade.

U.S. Pat. No. 7,025,642, which issued to Baylor on Apr. 11, 2006, describes a boat propeller which includes a hub having a front, back, and an axis of revolution extending therebetween. A plurality of blades provides and extends from the hub between the front and back. Each blade includes a surface adjacent of the hub disposed at an oblique angle to the hub axis and a blade tip having an adjacent surface forming a dihedral angle with a surface adjacent to the hub extending on the forward camber only. The surface adjacent to the blade tip is inclined at a greater angle to the hub axis than the surface adjacent to the hub.

The patents described above are hereby expressly incorporated by reference in the description of the present invention.

SUMMARY OF THE INVENTION

A marine propeller, made in accordance with a preferred embodiment of the present invention, comprises a generally cylindrical hub having a central axis and three blades that are attached to the hub and extend radially outward from the hub. The propeller has a blade area ratio between 55 percent and 65 percent and, in a particularly preferred embodiment of the present invention, it has a blade area ratio of approximately 60 percent. Each of the blades has a skew angle between 28 and 38 degrees and, in a particularly preferred embodiment of the present invention, the skew angle is approximately 33 degrees. Each of the blades also has a rake angle between 23.5 degrees and 33.5 degrees and, in a particularly preferred embodiment of the present invention, the rake angle is approximately equal to 28.5 degrees. In a preferred embodiment of the present invention, the rake angle is progressive. The blades are tail loaded and the diameter of a propeller made in accordance with a preferred embodiment of the present invention is a function of the pitch of the blades according to the relationship $D=(-0.23P)+X$, where P is the pitch, D is the diameter and X is between 17.93 and 18.93 inches.

BRIEF DESCRIPTION OF THE DRAWINGS

The present invention will be more fully and completely understood from a reading of the description of the preferred embodiment in conjunction with the drawings, in which:

FIGS. 6-9 illustrate data obtained during a plurality of tests run on marine propellers having different design parameters;

DESCRIPTION OF THE PREFERRED EMBODIMENT

Figure 1:
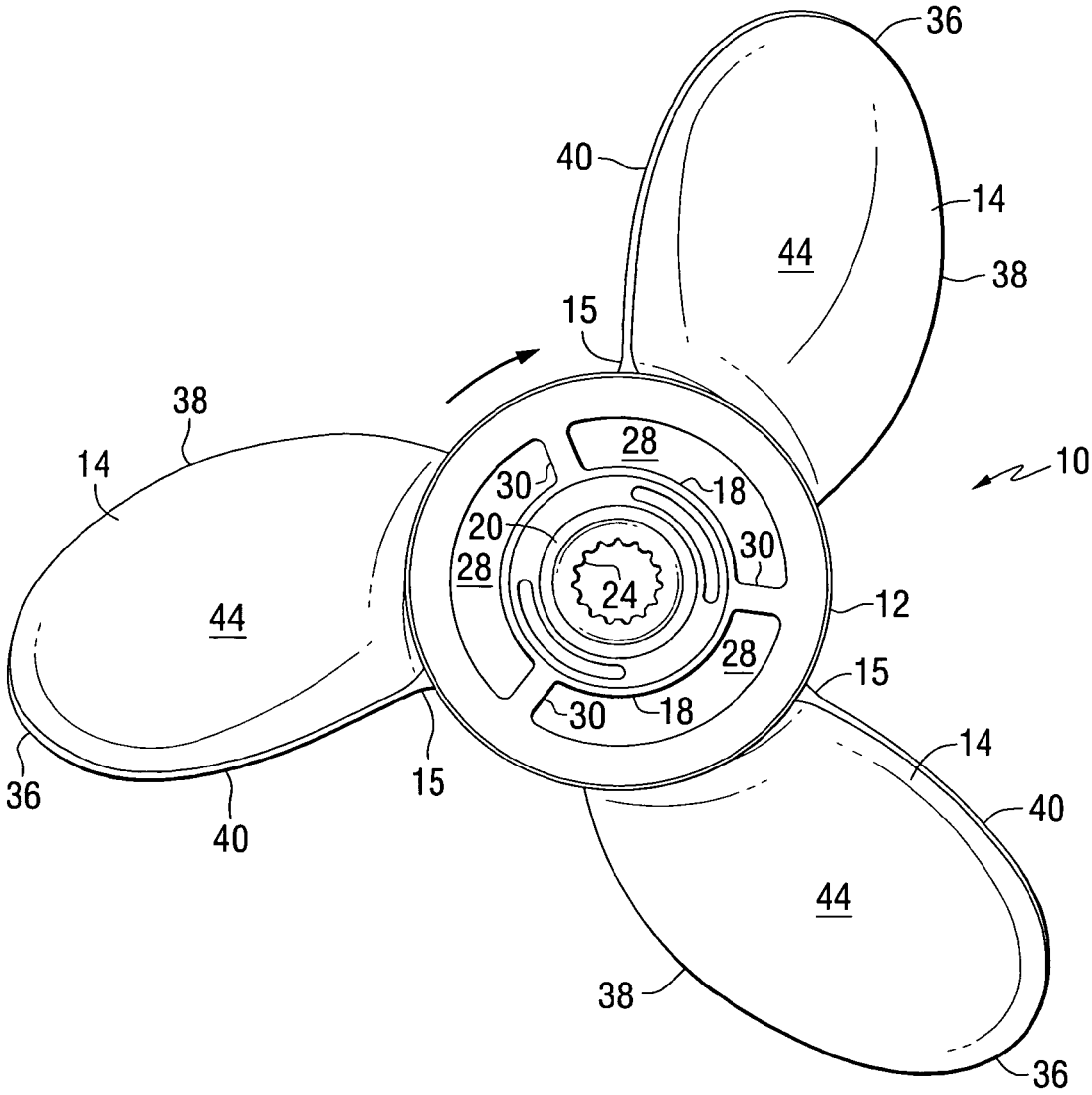
FIG. 1 illustrates a marine propeller viewed from directly behind the propeller.

Throughout the description of the preferred embodiment of the present invention, like components will be identified by like reference numerals.

The present invention relates to a marine propeller that has a particularly advantageous combination of characteristics which improves the acceleration capability, the top speed capability and the cruising speed capability of the propeller. In order to achieve these advantageous performance characteristics, various parameters were compared to each other, in different combinations, to determine the most advantageous combination of those design parameters.

In order to fully understand the preferred embodiment of the present invention, it is helpful to understand the meaning of those various design parameters. Before describing the particular combination of design parameters of a preferred embodiment of the present invention, each of those parameters will be described below.

FIG. 1 shows a view of a propeller 10 as seen from a position behind a marine propulsion device. In the central portion of the propeller 10, an outer hub 12 is attached to a plurality of blades 14. In the propeller illustrated in FIG. 1, an inner hub 18 is rigidly attached to the outer hub 12 and contains a shock absorbing rubber portion 20. An inner metallic member 24 is provided with spline teeth that are configured to mate with spline teeth of a propeller shaft of a marine propulsion device. The space identified by reference numeral 28 is an exhaust passage through which exhaust gases can pass in certain types of propellers. The ribs that connect the outer and inner hubs, 12 and 18, are identified by reference numeral 30.

With continued reference to FIG. 1, reference numeral 36 identifies the blade tips, reference numeral 38 identifies the leading edges of the blades 14, and reference numeral 40 identifies the trailing edges of the blades 14. Reference numeral 44 identifies the blade face of each of the blades 14. The opposite surface of each blade is referred to as the blade back.

With continued reference to FIG. 1, the maximum reach of the blade from the center of the propeller hub is the blade tip 36. It separates the leading edge 38 from the trailing edge 40. The leading edge 38 is the part of the blade 14 that is closest to the boat to which the marine propulsion device is attached. It is the first part of the blade that cuts through the water. The leading edge 38 extends from its root 15 at the outer hub 12 to the tip 36. The trailing edge 40 is the part of the blade 14 which is farthest from the boat to which the marine propulsion device, such as an outboard motor, is attached. It is the edge from which the water leaves the blade 14. It extends from the tip 36 to the outer hub 12. The blade face 44 is that side of the blade 14 which faces away from the boat. It is also commonly referred to as the positive pressure side of the blade. The blade back is the side of the blade 14 facing the boat and is commonly referred to as the negative pressure, or suction, side of the blade 14. The blade root 15 is the point at which the blade 14 attaches to the outer hub 12. The inner hub 18 typically contains some type of resilient component, such as a rubber hub or an insert sleeve made of plastic material. The forward end of the inner hub is typically a metal surface which generally transmits propeller thrusts through a thrust hub to the propeller shaft and, in turn, to the boat. The outer hub 12 is separated from the inner hub 18 in propellers that are intended for conducting exhaust gases through the center 28 of their structure. The outer surface of the outer hub 12 is in direct contact with water. The blades 14 are attached to this outer surface. The inner surface of the outer hub 12 is in contact with the exhaust passage and with the ribs 30 which attach the outer hub 12 to the inner hub 18. This type of propeller can have three ribs 30 as shown, but occasionally has two, four, or five ribs. The ribs are typically either parallel to the propeller shaft or parallel to the blades.

Figure 2A:
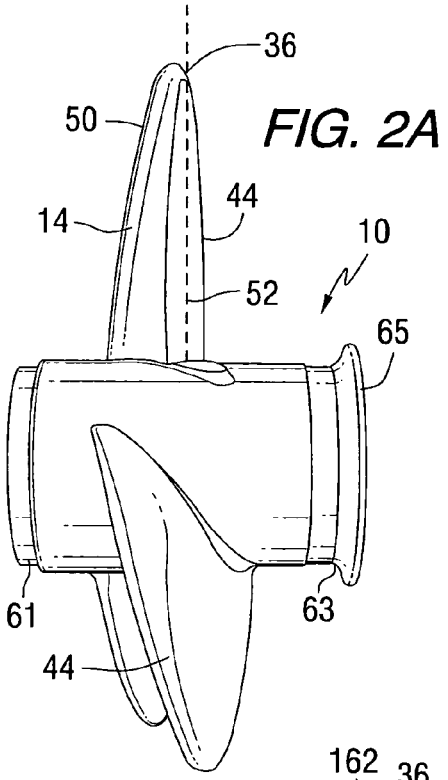
FIGS. 2A-2C are views of a marine propeller showing various alternative design parameters.
Figure 2B:
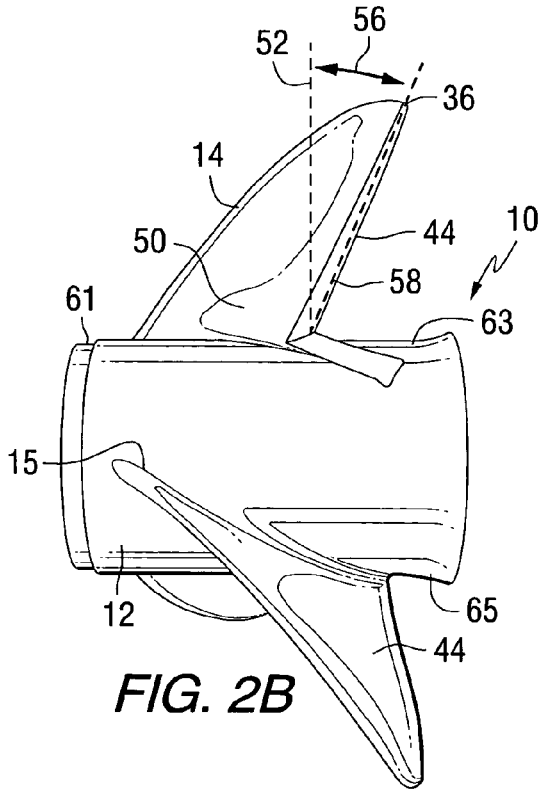
Figure 2C:
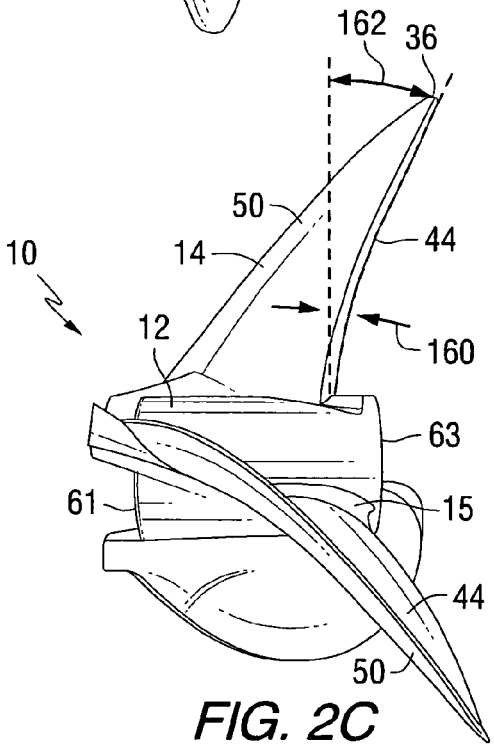

FIGS. 2A, 2B, and 2C, illustrate various types of rake that are possible in propeller designs. Each of these figures show a section view through a blade, wherein the section is a cut taken along a plane that is generally parallel to a central axis of rotation of the propeller and extends through the axis of rotation and the blade tip 36. The face side 44 of the cross-sectional surface of that cut, relative to a plane that is perpendicular to the propeller axis, represents the blade rake. If the blade face 44 of the blade is generally perpendicular to the propeller hub, as represented by dashed line 52 in FIG. 2A, the propeller has a zero degree rake. As the blade 14 slants back toward the aft end of the propeller 10, the blade rake increases. For example, FIG. 2B illustrates a flat rake with an angle represented by arrow 56. That is the distance between dashed line 52 and dashed line 58 in FIG. 2B. As described above, this is also the angle between the face side 44 of the cross-sectional surface of the cut blade relative to a plane that is perpendicular to the propeller axis. Dashed line 52 represents the plane that is perpendicular to the propeller axis and dashed line 58 represents the face side 44 of the blade 14. Many types of well known propellers have rake angles that vary from minus five degrees to plus twenty degrees. Basic propellers for use with outboard engines and sterndrive propulsion units commonly have a rake of approximately 15 degrees. Higher rake (higher performance) propellers often have progressive rake which may be as high as 30 degrees at the blade tip 36. FIG. 2C illustrates a progressive rake that varies, as represented by dimensions 160 and 162 in FIG. 2C. In most propeller designs, the rake is either flat, as illustrated in FIGS. 2A and 2B, or curved (progressive) as illustrated in FIG. 2C.

With continued reference to FIGS. 2A, 2B, and 2C, those skilled in the art of propeller design are familiar with the fact that a higher rake angle generally improves the ability of the propeller to operate in a cavitating or ventilating situation, such as when the blades break the water's surface. When such surfacing occurs, higher blade rake can hold the water as it is being thrown into the air by centrifugal force and, in doing so, can create more thrust than a similar, but lower, raked propeller. On lighter, faster boats, with a higher engine or drive transom height, higher rake often will increase performance by holding the bow of the boat higher, resulting in higher boat speed due to less hull drag. However, with some very light, fast boats, higher rake can cause too much bow lift and, as a result, cause these boats to be less stable.

Figure 3:
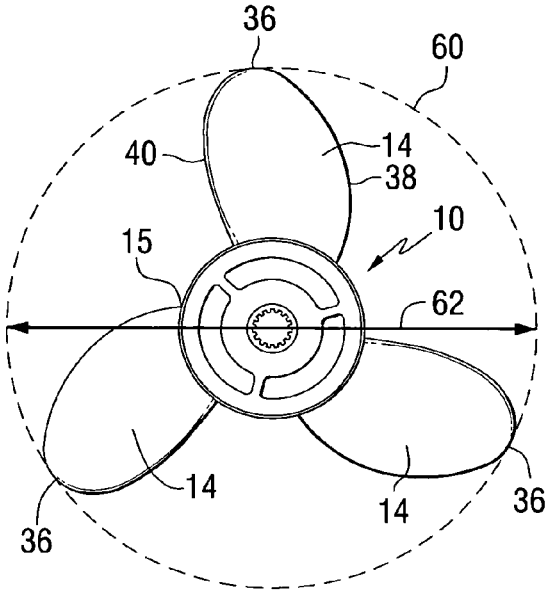
FIG. 3 illustrates a marine propeller showing its diameter in relation to its blade tips.

FIG. 3 shows a propeller 10 which is generally similar to the propeller illustrated in FIG. 1, but with a dashed circle 60 representing a circle made by the blade tips 36 as the propeller 10 rotates. The diameter of that circle 60 is represented by arrow 62 in FIG. 3. The choice of diameter 62 is determined primarily by the rotation speed, measured in RPM, at which the propeller will be expected to turn and by the amount of power that will be delivered to the propeller through the shafts and gears used in the marine propulsion device on which the propeller is attached. Also, the degree to which the propeller may operate in a partially surfaced condition, as well as the intended forward velocity of the boat, will also play a role in determining the most desirable diameter 62. Within a particular style of propeller, the diameter 62 usually increases for propellers used on slower boats and decreases for propellers used on faster boats. If all other variables are considered to be constant, the design diameter 62 will typically be increased for increased power and as intended rotational speed (i.e. RPM) decreases. Diameter 62 should also increase as propeller surfacing increases in likelihood.

Figure 4:
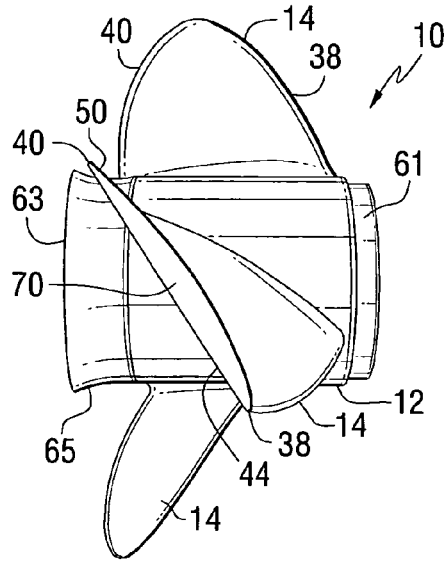
FIG. 4 is a side view of a marine propeller with one blade section to show its cross-sectional profile.

FIG. 4 is a side view of a propeller 10 with three blades 14 which are shown extending from the outer hub 12. The front portion of the hub, identified by reference numeral 61, is shown toward the right in FIG. 4 and the aft end 63 of the outer hub 12 is shown toward the left. The flared edge 65 at the rear portion 63 of the hub 12 is provided on some propellers to aid in reducing the likelihood that exhaust gas can flow into the propeller blades 14. This flared edge 65 is commonly referred to as a diffuser ring and it reduces the exhaust back pressure in that region. One of the blades 14 in FIG. 4 is sectioned to show its profile 70. As can be seen in the shape of the section surface 70, the thickness of the blade 14 varies from its leading edge 38 to its trailing edge 40. An approximately flat surface can be seen at the blade face 44, or positive pressure side, of the blade. A curved back surface 50 can be seen on the negative, or suction, side of the blade. The thickest portion of the blade is near its center, between the leading 38 and trailing 40 edges.

Figure 5A:
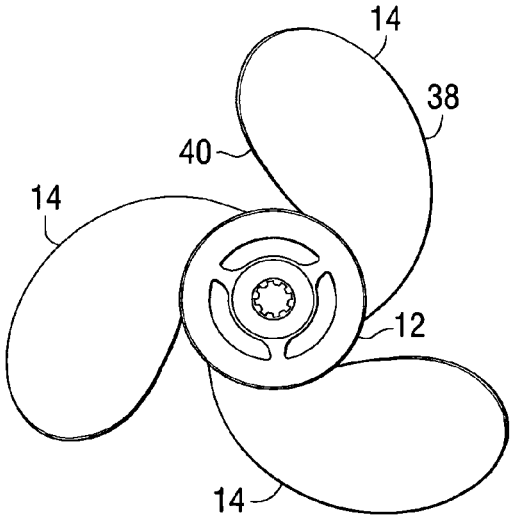
FIGS. 5A and 5B show marine propellers having different skews.
Figure 5B:
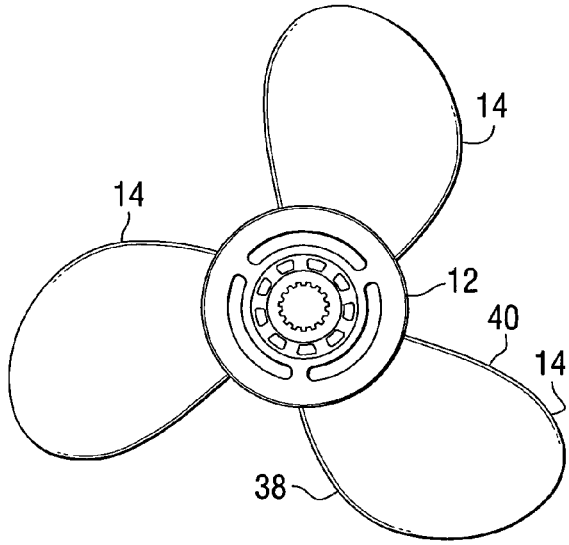

FIGS. 5A and 5B show two propellers which differ noticeably from each other by their magnitude of skew. A propeller with significant skew, such as that shown in FIG. 5A, has blades 14 which are swept back at a greater angle than a propeller with less skew as shown in FIG. 5B. Considerable skew is sometimes helpful in allowing a propeller to more easily shed weeds. Higher skew on a surfacing propeller application will reduce the impact vibration caused by a propeller blade reentering the water. With continued reference to FIGS. 1, 2A-2C, 3, 4, 5A, and 5B, it should be understood that the performance of any propeller is determined by the cumulative effect of the combination of its design parameters.

The pitch of a propeller is the distance that a propeller would move in one revolution if it were moving through a soft solid material, in the manner that a screw moves through a piece of wood. Pitch is measured at the face of the blade. A number of factors can cause the actual pitch of a propeller to differ from its identified pitch. Minor distortion of the blades may have occurred during the either the casting or cooling process as the propeller was being manufactured. Adjustments or modifications may have been made during repair operations. In addition, undetected damage may alter the pitch of a propeller. Propellers can have a constant pitch or a progressive pitch. Constant pitch means that the pitch is the same at all points from the leading edge 38 to the trailing edge 40. Progressive pitch usually begins as a low magnitude at the leading edge and progressively increases to a higher magnitude of pitch at the trailing edge. The pitch number assigned to a propeller is usually the average pitch over the entire blade. Pitch is the theoretical distance that the boat travels during one complete revolution of the propeller. In other words, a 10 inch pitch propeller would theoretically move the boat 10 inches in the forward direction during one complete revolution of the propeller.

A design parameter relating to propellers is the disk area ratio (DAR) or the blade area ratio (BAR). This number represents the total area of the blades 14 of the propeller in comparison to the total area of the circle of the same diameter. For example, with reference to FIG. 3, the total area of the blades 14 as viewed in the illustration divided by the area of circle 60 would provide a measure of the disk area ratio (DAR). The difference between DAR and BAR will be described in greater detail below.

In order to determine an optimum, or near optimum, combination of the various design parameters that provides superior performance in relation to acceleration, top speed, and cruising speed, numerous prototype propellers were manufactured with different combinations of these design parameters. Those prototypes were tested repeatedly and the results were analyzed to allow the selection of a combination of these parameters that is preferable in all or most of those selected performance criteria. For this testing, the number of blades on the propellers were three or four, the rake angle was 15 degrees or 25 degrees, the blade area ratio (BAR) was 50 percent or 60 percent, the pitch load, or blade load distribution was uniform or tail-loaded, and the skew of the blades was 10 degrees or 33 degrees. The term "uniform" as used to describe the tests, is not intended to mean perfectly uniform but instead, more uniform than the tail loaded propeller. The four tests comprised a top speed test, an acceleration test from 0 to 20 miles per hour, an acceleration test from 0 to 30 miles per hour, and a cruising speed test. The cruising speed test was done at 4,000 RPM with an optimum trim of the outboard motor. Initially a best trim position was selected for each propeller. In later tests, a common trim point was selected to help define a more stable cruise speed test. The acceleration tests were performed at wide open throttle (WOT) with the outboard motor trimmed to be fully tucked in toward the boat. The top speed test was done at wide open throttle and the top speed was the speed achieved by the boat when the speed stabilized while the outboard motor was trimmed for best performance of that particular propeller.

FIG. 6 is a table showing the top speed results obtained during the testing of a plurality of combinations of the design parameters described above. It can be seen that the results in the seventh row of the table in FIG. 6 indicate the propeller which achieved the highest top speed which is 38.3 miles per hour. That top speed was achieved with a three blade propeller, a 25 degree rake angle, a 60 percent BAR, a tail loaded blade profile, and a skew angle of 33 degrees. It can be seen that rows 9, 10, 12 and 14 do not contain a top speed result. The reason for this is that those propellers' blades "broke loose" and had to be decelerated during the tests.

FIG. 7 shows the results of the acceleration test, from 0 to 20 mile per hour, for 16 different propellers, each of which has a unique combination of blade number, rake angle, BAR, pitch load, and skew. The fastest acceleration from 0 to 20 mile per hour was 6.2 seconds which was achieved by the propeller identified in row 7. Again, this propeller had three blades, a rake angle of 25 degrees, a BAR of 60 percent, a tail loading pitch load, and a skew angle of 33 degrees.

FIG. 8 illustrates the results of the acceleration tests from 0 to 30 mile per hour. As can be seen in FIG. 8, this particular test was only run with three bladed propellers. The best acceleration was achieved by the propellers identified in rows 1 and 7. Both of these propellers accelerated to 30 mile per hour in 15.2 seconds. The propeller identified in row 1 had three blades, a rake angle of 15 degrees, a BAR of 50 percent, a tail-loaded pitch load, and a skew angle of 33 degrees. The propeller identified in row 7, as described above, had three blades, a rake angle of 25 degrees, a BAR of 60 percent, tail loading, and a skew angle of 33 degrees. Based solely on the results shown in FIG. 8, it would appear that the two propellers identified in rows 1 and 7 represent the best combination of design parameters to maximum acceleration from 0 to 30 mile per hour. The four bladed propellers all "broke loose" during the tests and accurate results could not be obtained for this test.

FIG. 9 illustrates the results of the cruising speed test in which the rotational speed was set to 4000 RPM and the resulting velocity was measured. As can be seen in FIG. 9, the optimum cruising speed of 21.1 miles per hour was achieved by the propeller identified in row 7.

With continued reference to FIGS. 6-9 and the results contained therein, it should be understood that slight variations from the specific magnitudes of the tested parameters can possibly achieve finite improvements in the tested characteristics, such as top speed, acceleration, or cruising speed. Since the design parameters were selected to define two specific magnitudes for each parameter, it should be recognized that an optimum magnitude for one or more of the parameters could be slightly different than the selected optimum described above. In other words, all of the propellers tested had a rake angle of either 15 degrees or 25 degrees. As a result, the tests were binary in nature. No propellers in this particular initial experiment had a rake angle of any other magnitude except 15 degrees and 25 degrees. Similarly, all of the propellers had either three or four blades. They all had a BAR of either 50 percent or 60 percent. They were all either uniformly loaded or tail loaded and they all had skew angles of either 10 degrees or 33 degrees.

Although not illustrated in the figures, the numerical results shown in the tables in FIGS. 6-9 were all also examined graphically to show consistency of trends. Those graphical results were also examined to show whether or not a perceived benefit from a particular value of a specific design parameter was consistently beneficial or dependent on other parameters to show a benefit. As an example, a three bladed prop was preferable over a four bladed prop regardless of the rake angle, the BAR, the pitch load, or the skew angle. Similarly, a BAR of 60 percent was generally preferable over a BAR of 50 percent regardless of the number of blades, the rake angle, the pitch load, or the skew with regard to the cruising speed achieved. However, the most beneficial pitch load, between tail loading or uniform loading, varied as a result of the number of blades on the propeller, the rake angle, the BAR, and the skew angle. In other words, with regard to cruising speed, the effect of one pitch load selection over another was much less significant than the other design variables. With regard to the acceleration tests, the skew angle of 33 degrees produced consistently better results than a skew angle of 10 degrees for both three and four blades props, rake angles of both 15 and 25 degrees, BAR's of both 50 percent and 60 percent, and under both selected pitch loads. Pitch loading, on the other hand, produced results that depended on the effects causes by other design parameters. The number of blades, the rake angle, and the BAR showed consistent results regardless of the other parameters combined with them. Theses results indicated the benefits of a three bladed propeller with a rake angle of 25 degrees and a BAR of 60 percent. Similarly, a graphical analysis of the data shown in FIGS. 6-9 also showed that the number of blades, the BAR, and the skew angle consistently determine the optimum results. Three blades, a BAR of 60 percent, and a skew angle of 33 degrees optimized the performance regardless of the other design parameters. With regard to top speed, the rake angle did not appear to be determinative since the results depended more on the other variables than the magnitude of the rake angle itself. Similarly, the pitch load was less determinative in achieving optimum results than the other design parameters.

As a result of both numerical and graphical reviews of the data represented in 6-9, it can be seen that certain combinations of tested parameters provide superior performance over other combinations of tested alternative parameters. However, it cannot be concluded that, for example, a 25 degree rake angle is superior in all circumstances. The test results show that a 25 degree rake angle is superior to a 15 degree rake angle, but do not disprove the hypothesis that some other magnitude of rake angle, perhaps between 15 degrees and 25 degrees or perhaps greater than 25 degrees, might actually be the best magnitude for the rake angle. Similarly, although a skew angle of 33 degrees was shown to be superior to a skew angle of 10 degrees, the tests performed and represented in FIGS. 6-9 do not preclude the possibility that some slightly different skew angle, perhaps between 10 degrees and 33 degrees or perhaps greater than 33 degrees, may have been preferable to the two magnitudes that were tested. The same can be said for the BAR and the pitch load. Therefore, although the present invention has been described above, as a result of the tests, in specific terms relating to three blades, a rake angle of 25 degrees, a BAR of 60 percent, tail loading, and a skew angle of 33 degrees, it should be understood that slight variations of these specific magnitudes could yield equivalent or slightly superior results. In fact, subsequent to the testing represented in FIGS. 6-9, adjustments were made to the prototype identified in row 7. The rake angle, for example, was changed from 25 degrees to 28.5 degrees and the rake was made progressive as will be described in greater detail below.

Figure 10A:
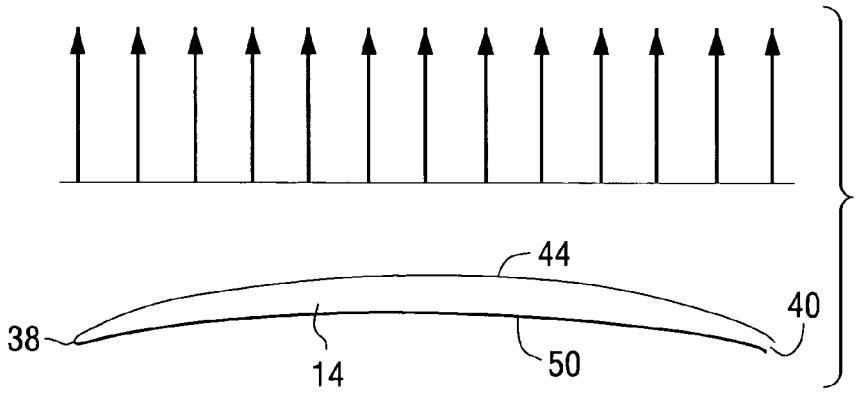
FIGS. 10A and 10B illustrate a uniform loading and a tail loading of a marine propeller blade.
Figure 10B:
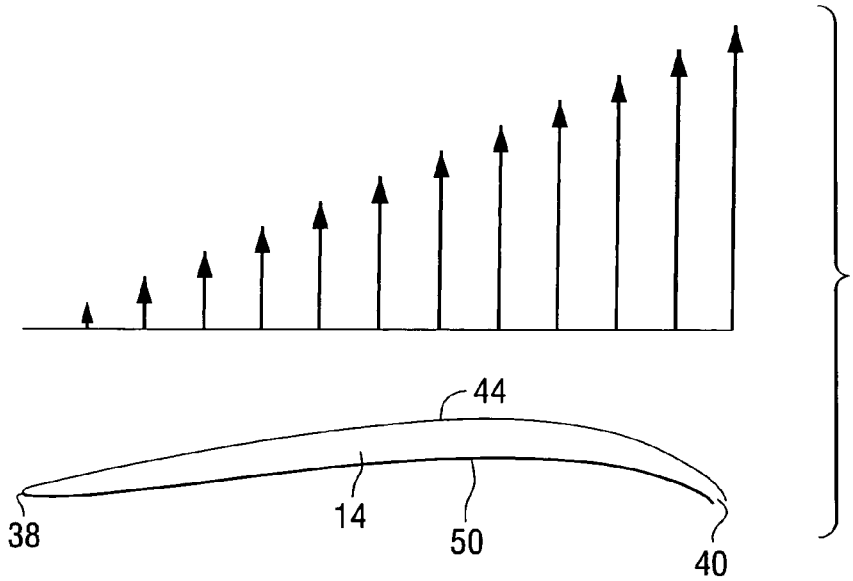

FIGS. 10A and 10B illustrate the concept of load distribution in relation to the blade face 44 of the propeller blades 14. The arrows represent the exemplary local pressure magnitude along the blade surface. It should be understood that the cross-sectional representations in FIGS. 10A and 10B are intentionally exaggerated to illustrate the type of changes in blade profile that can be implemented to affect the blade load distribution. As described above, the blade face 44 faces away from the boat and is the positive pressure side of the blade 14. The pressure difference on the surface of the blade face 44, in comparison to the pressure on the blade back 50, creates the thrust that propels a marine vessel.

FIG. 10A represents a uniform loading on a propeller blade 14. The amount of pressure load between the leading edge 38 and a midpoint, between the leading 38 and trailing 40 edges is generally equal to the pressure loading between that midpoint and the trailing edge 40. Throughout the description of the preferred embodiment of the present invention, the type of loading illustrated in FIG. 10A is referred to as "perfectly uniform loaded". As described above, the "uniform loaded" blades that were tested were not perfectly uniform loaded, but were more uniform than the tail loaded blades.

FIG. 10B illustrates a type of loading that is referred to herein as "tail loaded". The portion of the load on the rear half of the blade 14, between a midpoint and the trailing edge 40, is greater than the portion of the load on the is surface of the blade between that midpoint and the leading edge 38. During the testing of the various alternative propeller blade designs described above, the blades that were tail loaded generally performed better than the uniform loaded blades. However, the effect caused by the tail loading was less significant than the beneficial effect caused by some of the other parameter choices.

Figure 11:
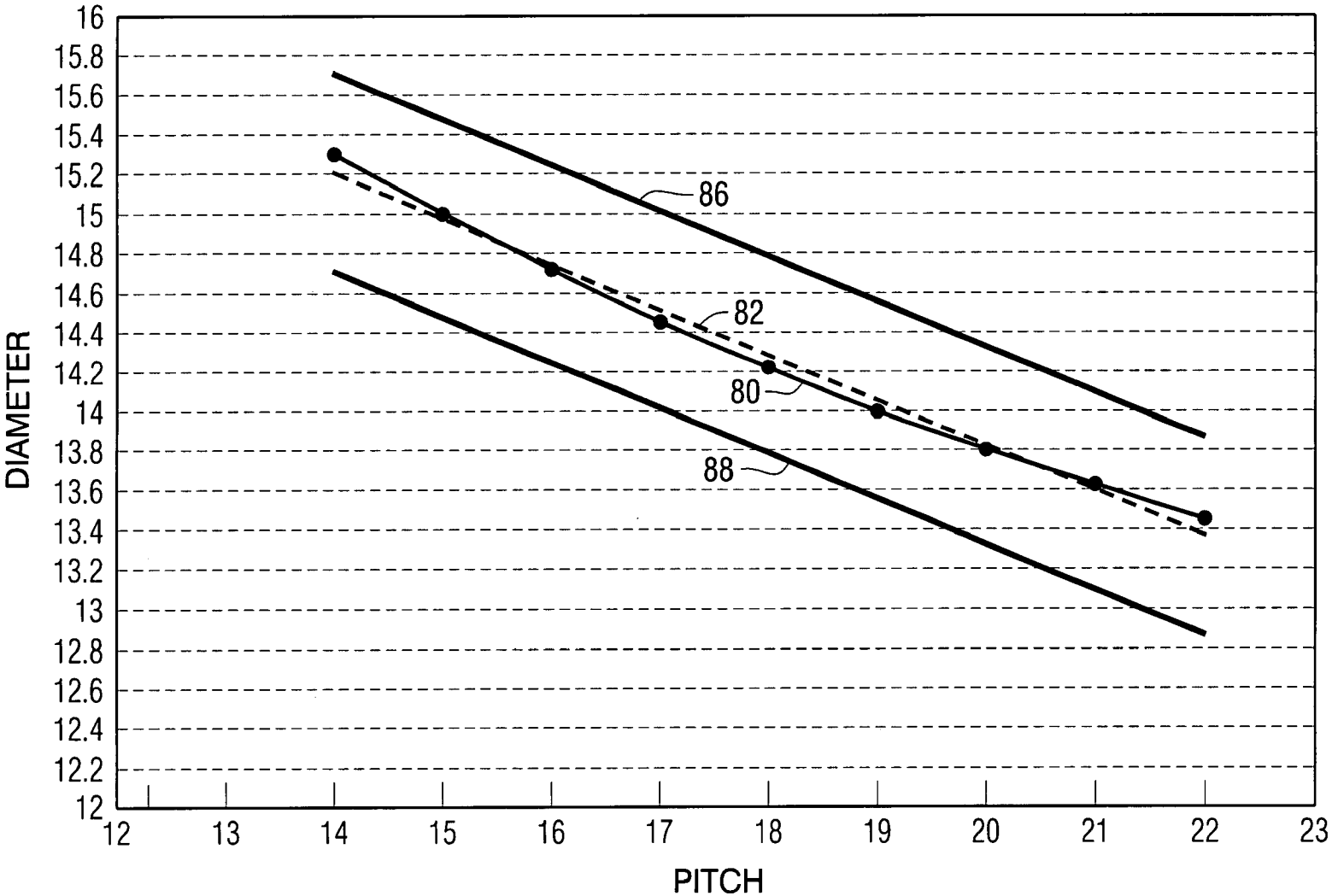
FIG. 11 is a graphical illustration of the relationship between pitch and diameter in a preferred embodiment of the present invention.

FIG. 11 illustrates a preferred relationship between the diameter of the propeller and the pitch of its blades in a preferred embodiment of the present invention. Line 80 represents the relationship between the diameter and the pitch. As can be seen, the line comprises nine individual points for specific pitch magnitudes, from 14 to 22 inches. It can also be seen that line 80 is not perfectly linear. In fact, it is generally described by the equation $$D=(32.535)P^{-0.2861} \quad (1)$$

where D is the diameter and P is the pitch. Dashed line 82 is a linear approximation of the nine pitch values illustrated in relation to line 80. The equation of line 82 is $$D=(-0.2302P)+18.43 \quad (2)$$

where D is the diameter of the propeller and P is the pitch of its blades. It has been determined that the relation between pitch and diameter, as illustrated in FIG. 11, advantageously affects the overall performance of the propeller made in accordance with a preferred embodiment of the present invention. A preferred embodiment of the present invention therefore comprises a propeller diameter D, as a function of pitch P, which is defined between an upper limit 86 and a lower limit 88. The upper and lower limits, 86 and 88, are numerically defined as being +0.5 inches in diameter and −0.5 inches in diameter, respectively, relative to the most preferred linear relationship 82 for each of the pitch values.

Subsequent to the numerous actual tests performed, as described above in conjunction with FIGS. 6-9, further experimentation was performed to see if additional improvement could be obtained. As an example, the propeller identified in row 7 of FIGS. 6-9 was tested with a rake angle of 25 degrees. In combination with the other parameters used in that particular propeller prototype, the results were superior to the other propellers tested. However, after the results of the tests, as illustrated in FIGS. 6-9, were analyzed, it was determined that additional improvement might be possible.

Figure 12:
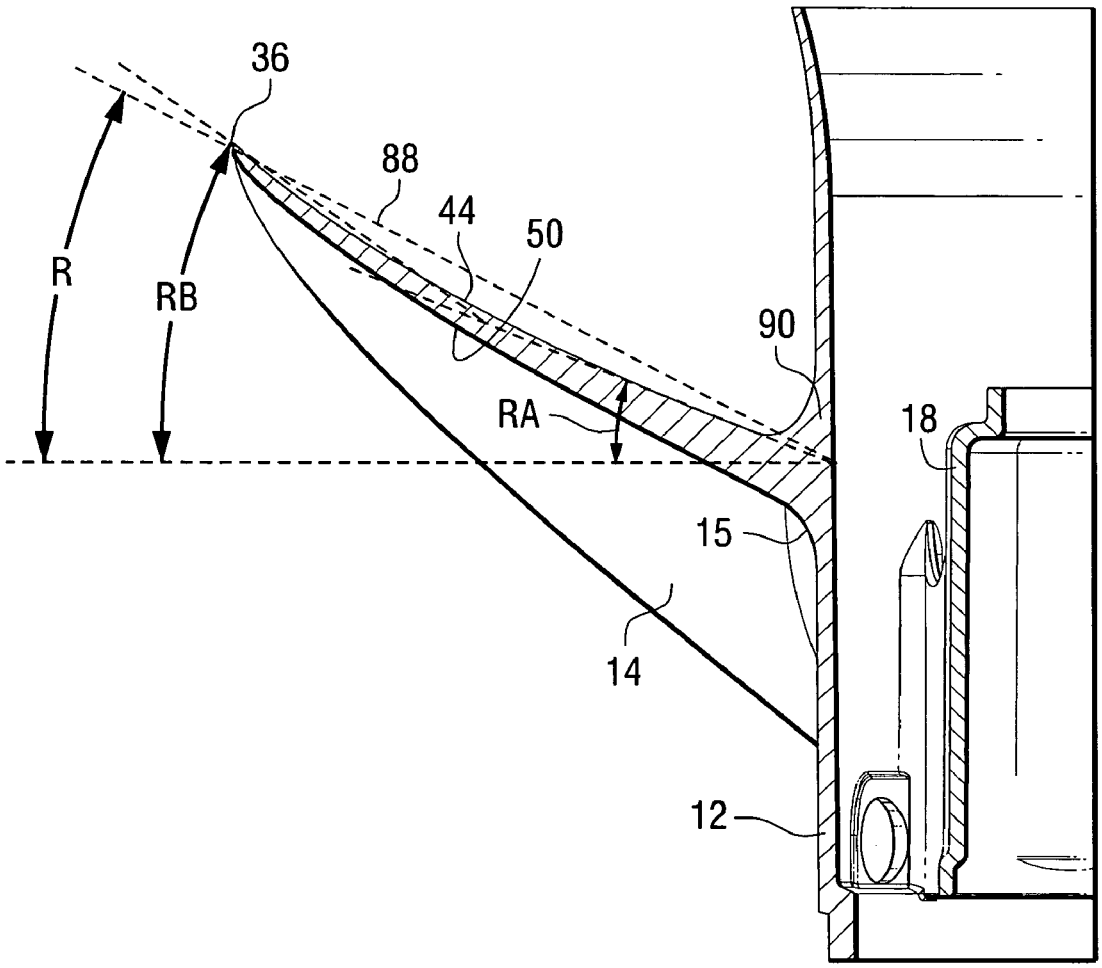
FIG. 12 illustrates a blade of the present invention to show its progressive rake.

FIG. 12 illustrates how the rake of the blades 14 was modified for these purposes. The overall rake angle, as identified by letter R and line 88 in FIG. 12, was modified to be generally equal to 28.5 degrees. In addition, each blade 14 was provided with a progressive rake which can be seen by comparing the shape of the blade face 44 with the straight dashed line 88. The rake of the blade face 44 progresses from an angle RA of approximately 23.5 degrees near the root 90 of the blade 14 to a much greater angle RB of approximately 50 degrees at the tip 36 of the blade. The outer hub surface 12 and a portion of the hub of the propeller are shown in FIG. 12 for purposes of more clearly illustrating the shape of the blade 14 in a preferred embodiment of the present invention.

Figure 13:
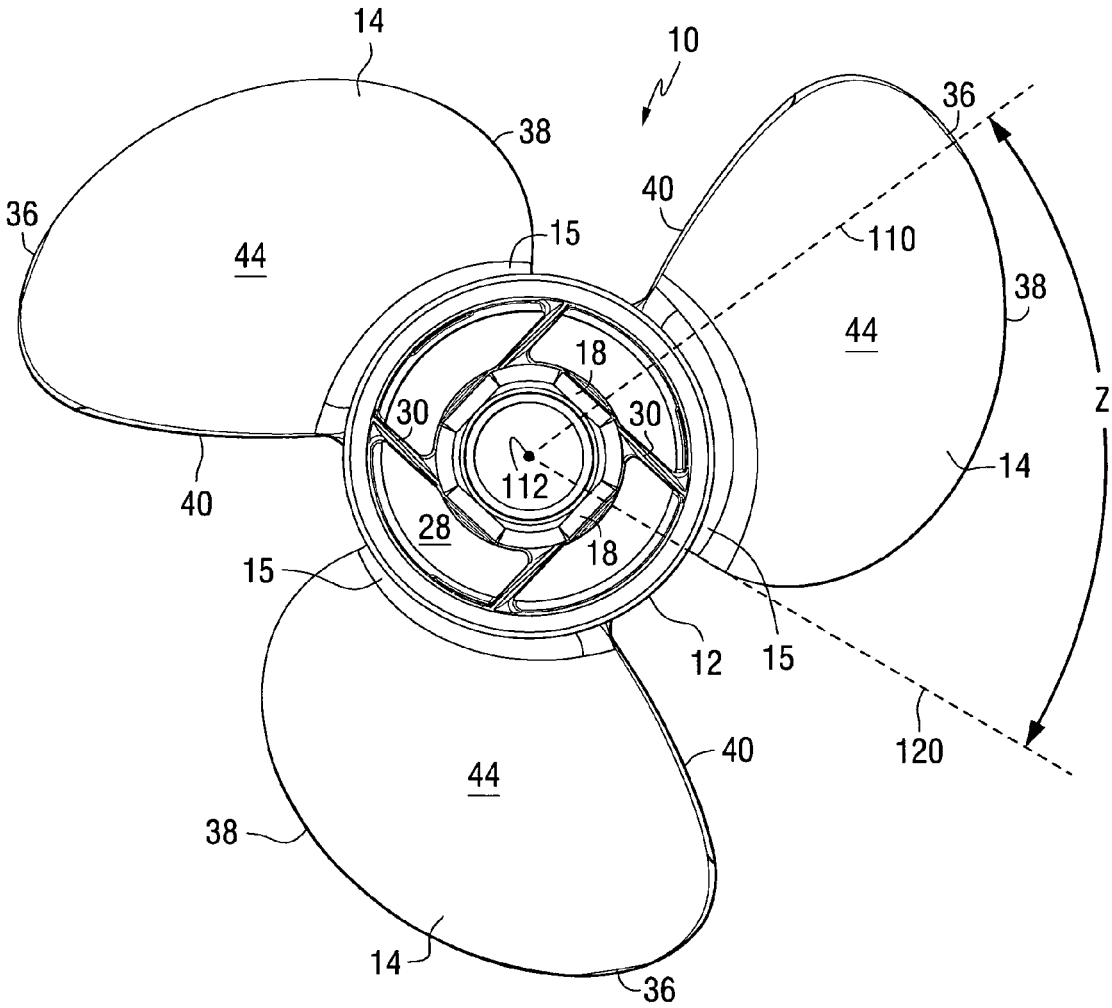
FIG. 13 shows a propeller made in accordance with a preferred embodiment of the present invention with a line showing the section through which the rake angles are taken.

FIG. 13 illustrates a propeller 10 made in accordance with a preferred embodiment of the present invention. The primary purpose of FIG. 13 is to illustrate the line 110 along which the section is taken to illustrate the rake of the blades 14 in FIG. 12. That dashed line 110 extends from the center 112 of the propeller 10 to the blade tip 36. In a preferred embodiment of the present invention, dashed line 110 is spaced apart from line 120, which extends through the leading edge 38 at the root of the blade 14 and through the center 112 of the propeller, by an angle Z illustrated in FIG. 13. In a preferred embodiment of the present invention, angle Z is approximately equal to 68 degrees.

The propeller with the altered rake of 28.5 degrees was later compared to the propeller identified in row 7 of FIGS. 6-9. The conditions of the later tests were different than for the tests described in FIGS. 6-9, but the results were nonetheless informative. In a repeat of the 0-20 mile per hour acceleration test, the altered propeller was 0.9 seconds faster (i.e. 5.0 seconds compared to 5.9 seconds) than the blade identified in row number 7. The altered blade had a progressive rake of 28.5 degrees (see FIG. 12) and the prototype identified in row 7 had a straight rake of 25 degrees. In the acceleration test from 0-30 miles per hour, the altered propeller was 2.3 seconds faster (i.e. 9.7 seconds compared to 12.0 seconds). The top speed and cruise speed results showed no significant improvement.

Figure 14:
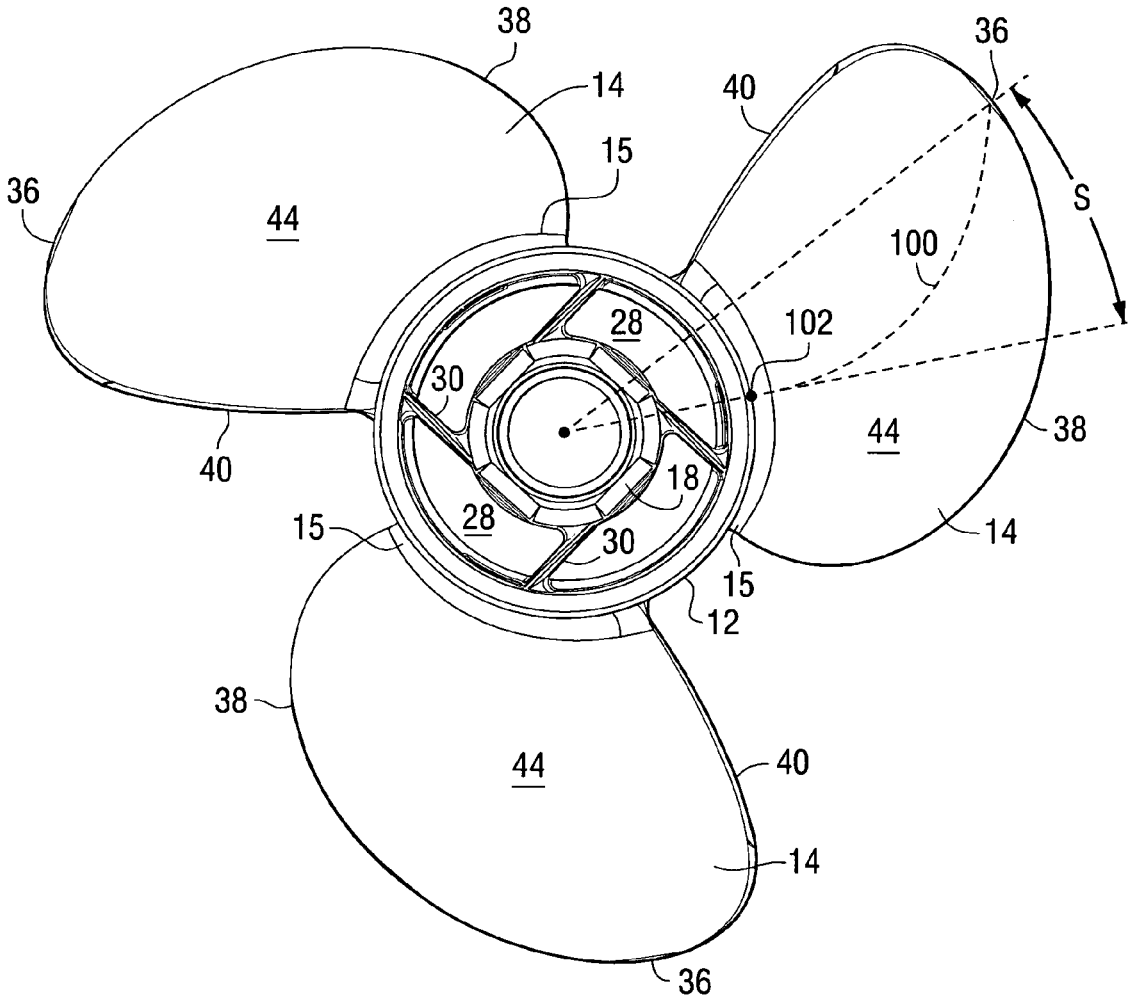
FIG. 14 shows a marine propeller made in accordance with a preferred embodiment of the present invention and illustrating a skew line of a representative blade.

FIG. 14 shows a preferred embodiment of the present invention. A skew line 100 is illustrated extending from a point 102 at the surface of the outer hub 12 to the blade tip 36.

As can be seen, the skew line 100 is curved along a path that generally describes an arc of a circle. The skew line 100 is generally perpendicular, at point 102, to the surface of the outer hub 12 and it curves to meet the blade tip 36 as shown. The overall skew S in a preferred embodiment of the present invention is generally equal to 33 degrees. This conforms with the results obtained from the numerous tests described above in conjunction with FIGS. 6-9.

Figure 15:
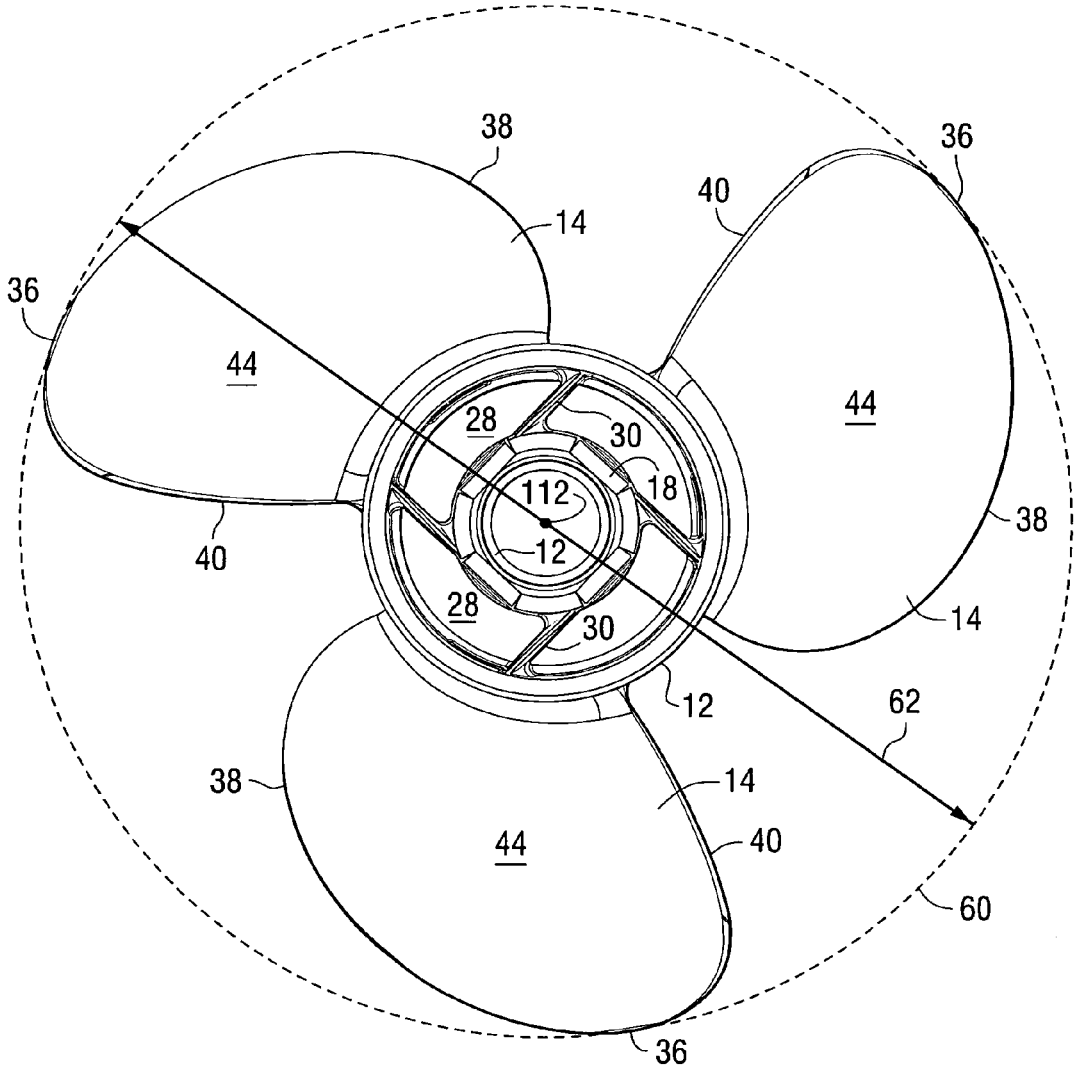
FIG. 15 shows a preferred embodiment of the present invention along with its diameter circle relative to its blade tips.

FIG. 15 illustrates the circle 60, defined by a diameter 62, that extends through the center 112 of the propeller, whose circumference extends through the blade tips 36. As described above, in conjunction with FIG. 11, the diameter of a preferred embodiment of the present invention is selected as a function of the pitch of the blades 14 according to the upper and lower limits, 86 and 88, described above in conjunction with FIG. 11.

With reference to FIGS. 1-15, it can be seen that a marine propeller made in accordance with a preferred embodiment of the present invention comprises a generally cylindrical hub 12 having a central axis 112 and three blades 14 which are attached to the hub 12 and which extend radially outward from the hub. The propeller has a blade area ratio (BAR) between 55 and 65 degrees and each of the blades 14 has a skew angle between 28 and 38 degrees. In a particularly preferred embodiment of the present invention, each of the blades 14 has a rake angle between 23.5 degrees and 33.5 degrees and the blades 14 are tail loaded. A marine propeller made in accordance with a preferred embodiment of the present invention can have blades of various pitch magnitudes. The test represented in FIGS. 6-9 were run with propellers having a pitch of 15 inches. The diameter 62 of the propeller 10, in a particularly preferred embodiment, is a function of the pitch of the blades as defined by the relationship $$D=(-0.23)P+X \tag{3}$$

where P is the pitch, D is the diameter and X is a value between 17.93 and 18.93 inches. In a particularly preferred embodiment of the present invention, the propeller has a blade area ratio (BAR) which is generally equal to 60 percent and the blades have a skew angle of approximately 33 degrees. Also, in a particularly preferred embodiment of the present invention, each of the blades has a rake angle which is generally equal to 28.5 degrees.

The description of the preferred embodiment of the present invention uses numerous terms that are generally known to those skilled in the art. However, in order to avoid any misunderstanding based on potentially alternative definitions of some of these terms, they have been described in detail above. In order to assure that these terms are fully and completely understood, as used to describe a preferred embodiment of the present invention, some of them will be further described below.

Figure 16:
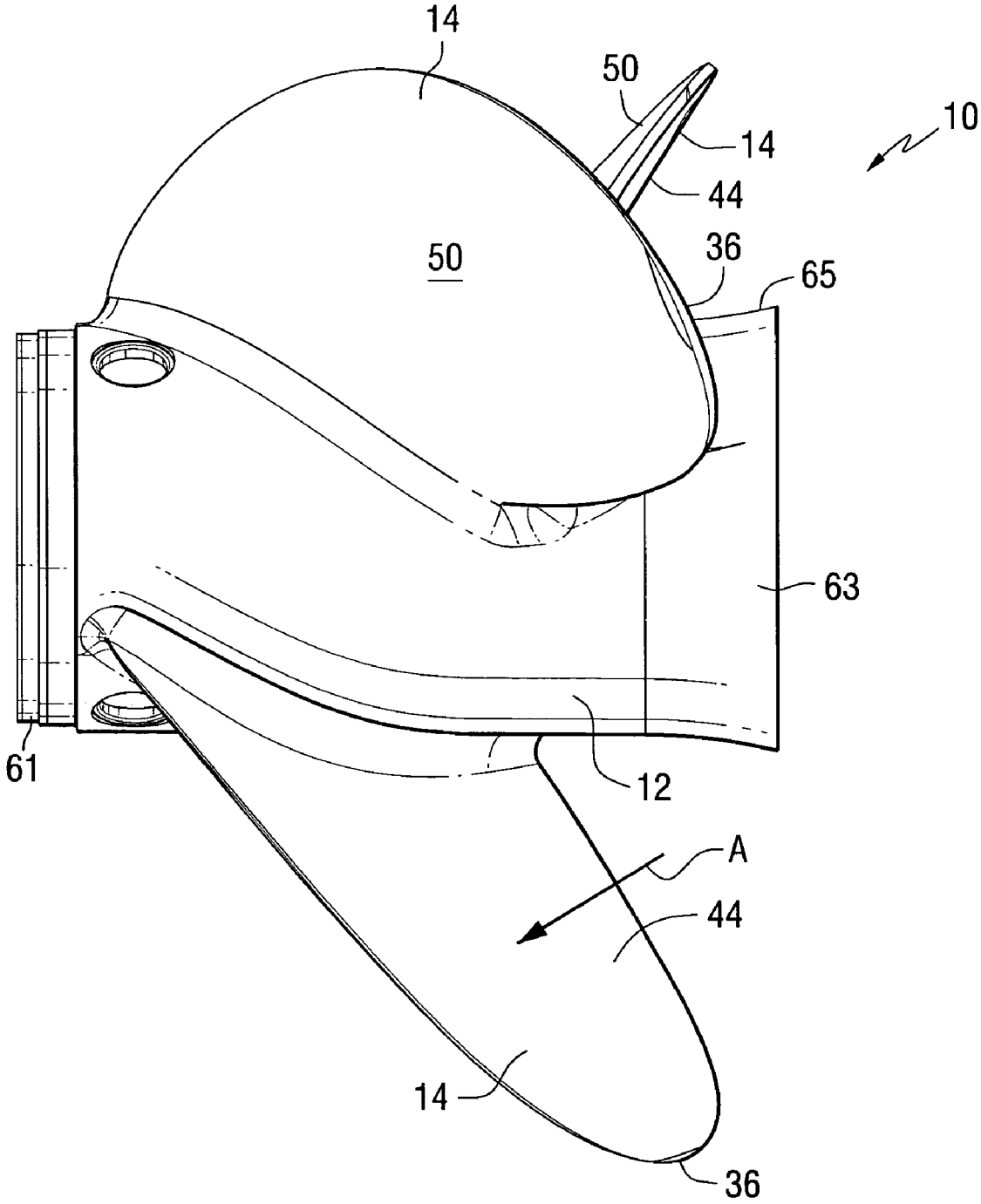
FIG. 16 is a side view of a marine propeller made in accordance with a preferred embodiment of the present invention.

The blade area ratio (BAR), or developed BAR, used to describe the present invention differs from the disk area ratio (DAR), or projected BAR, that is sometimes used to describe marine propellers. In order to illustrate the difference, reference is made to FIGS. 15 and 16. FIG. 15 is an illustration viewed from directly behind a marine propeller 10 along a line of sight which is parallel to the central axis 112 of the propeller blade and a propeller shaft to which it is attached. If the total visible area of the three blades in FIG. 15 is divided by the total area of circle 60, the resulting percentage is commonly referred to as the disk area ratio (DAR) by those skilled in the art of marine propeller design. However, it should be understood that the blades 14 are disposed at a pitch angle to the surface of FIG. 15 which is perpendicular to the central axis 112. In other words, the visible area of the blades 14 in FIG. 15 is probably significantly less than the actual surface area of those blades. In FIG. 16, arrow A represents a direction of viewing the surface area of the back face 44 of a blade 14. Arrow A in FIG. 16 is intended to represent one of numerous vectors be generally perpendicular to each radial section of the pressure surface 44 of the blade. It is recognized that the pressure surface, or blade face 44 of the blade 14, is curved. The total area of the blade sections, viewed in the perpendicular direction, also known as planform area, divided by the area of circle 60 in FIG. 15 results in the blade area ratio (BAR) as that term is used in the description of the preferred embodiment of the present invention. The terminology "blade area ratio", as used herein, is not intended to use expanded BAR, a blade area which is precisely equal to the total actual curved surface area of the blade face. In expanded BAR, the blade chord length is measured assuming there is no curvature. Instead, it is intended to use, as the numerator in the BAR calculation, the area seen when the blade sections 14 are viewed in a direction that is generally perpendicular to the blade face 50.

Although the present invention has been described with particular specificity and illustrated to show a particularly preferred embodiment, it should be understood that alternative embodiments are also within the scope of the present invention.

We claim:

1. A marine propeller, comprising:

a hub having a central axis; and three blades attached to said hub and extending radially outward from said hub, said propeller having a blade area ratio between 55 and 65 percent, each of said blades having a skew angle between 28 and 38 degrees;

wherein the diameter of said propeller is a function of the pitch of said blades which is defined by the relationship D=(−0.23P)+X, where P is the pitch, D is the diameter and X is between 17.93 and 18.93 inches.

2. The marine propeller of claim 1, wherein: each of said blades has a rake angle between 23.5 degrees and 33.5 degrees.

3. The marine propeller of claim 2, wherein:

each of said blades has a rake angle between 26.5 degrees and 30.5 degrees.

4. The marine propeller of claim 2, wherein:

each of said blades has a rake angle which is generally equal to 28.5 degrees.

5. The marine propeller of claim 1, wherein: each of said blades is tail loaded.

6. The marine propeller of claim 1, wherein:

X=18.4 inches.

7. The marine propeller of claim 1, wherein:

said propeller has a blade area ratio between 58 and 62 percent.

8. The marine propeller of claim 1, wherein:

said propeller has a blade area ratio which is generally equal to 60 percent.

9. The marine propeller of claim 1, wherein:

each of said blades has a skew angle between 31 and 35 degrees.

10. The marine propeller of claim 1, wherein:

each of said blades has a skew angle which is generally equal to 33 degrees.

* * * * *

UNITED STATES PATENT AND TRADEMARK OFFICE

CERTIFICATE OF CORRECTION

PATENT NO. : 7,637,722 B1
APPLICATION NO. : 11/526954
DATED : December 29, 2009
INVENTOR(S) : Koepsel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 671 days.

Signed and Sealed this

Ninth Day of November, 2010

David J. Kappos

David J. Kappos
*Director of the United States Patent and Trademark Office*